US009734758B2

(12) United States Patent
Imai et al.

(10) Patent No.: US 9,734,758 B2
(45) Date of Patent: Aug. 15, 2017

(54) DISPLAY DEVICE AND METHOD FOR DRIVING SAME

(71) Applicant: JOLED INC., Tokyo (JP)

(72) Inventors: Yuki Imai, Osaka (JP); Tomoyuki Maeda, Tokyo (JP); Mika Nakamura, Osaka (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 14/909,851

(22) PCT Filed: Oct. 15, 2014

(86) PCT No.: PCT/JP2014/005238
§ 371 (c)(1),
(2) Date: Feb. 3, 2016

(87) PCT Pub. No.: WO2015/056446
PCT Pub. Date: Apr. 23, 2015

(65) Prior Publication Data

US 2016/0232842 A1 Aug. 11, 2016

(30) Foreign Application Priority Data

Oct. 18, 2013 (JP) ..... 2013-217716

(51) Int. Cl.
*G09G 3/30* (2006.01)
*G09G 3/3233* (2016.01)
(Continued)

(52) U.S. Cl.
CPC ..... *G09G 3/3233* (2013.01); *G09G 3/3258* (2013.01); *G09G 3/3291* (2013.01);
(Continued)

(58) Field of Classification Search
CPC ..... G09G 3/3258; G09G 3/3291; G09G 2320/0626; G09G 2330/021; G09G 2360/16; G09G 2320/0223
(Continued)

(56) References Cited

U.S. PATENT DOCUMENTS 7,071,635 B2 7/2006 Inoue et al.
7,224,333 B2 5/2007 Yamazaki et al.
(Continued)

FOREIGN PATENT DOCUMENTS

JP 2000-242208 9/2000
JP 2003-280587 10/2003
(Continued)

OTHER PUBLICATIONS

Search Report from PCT/JP2014/005238, mail date is Jan. 27, 2015.

*Primary Examiner* — Jennifer Nguyen
(74) *Attorney, Agent, or Firm* — Greenblum & Bernstein, P.L.C.

(57) ABSTRACT

A display device includes light-emitting pixels, a voltage source, power supply lines for supplying drive voltage from the voltage source to each light-emitting pixel, a voltage drop amount estimating unit which estimates an amount of voltage drop between the voltage source and each light-emitting pixel, using video data indicating light emission luminance of each light-emitting pixel, a first storage unit which holds correction information indicating light emission characteristics obtained when a driving transistor in the light-emitting pixel operates both in linear and saturated regions, a second storage unit which holds reference characteristic information indicating light emission characteristics obtained when the driving transistor operates in the saturated region, and a luminance signal correcting unit which generates the luminance signal by correcting a reference level of the luminance signal associated with the light
(Continued)

emission luminance, based on the estimated amount of voltage drop and the correction information.

4 Claims, 10 Drawing Sheets

(51) Int. Cl.
*G09G 3/3258* (2016.01)
*G09G 3/3291* (2016.01)

(52) U.S. Cl.
CPC ..... *G09G 2320/0223* (2013.01); *G09G 2320/0626* (2013.01); *G09G 2330/021* (2013.01); *G09G 2360/16* (2013.01)

(58) Field of Classification Search
USPC ..... 345/76, 77, 211–212, 690; 713/300
See application file for complete search history.

(56) References Cited

U.S. PATENT DOCUMENTS

| | | | | |
|---|---|---|---|---|
| 7,872,619 | B2 | 1/2011 | Miller et al. | |
| 8,427,405 | B2 | 4/2013 | Takasugi | |
| 8,847,859 | B2 | 9/2014 | Fish et al. | |
| 8,866,807 | B2 | 10/2014 | Kato | |
| 8,933,923 | B2 | 1/2015 | Kato | |
| 9,058,772 | B2 | 6/2015 | Ebisuno et al. | |
| 2003/0146888 | A1 | 8/2003 | Yamazaki et al. | |
| 2004/0183483 | A1 | 9/2004 | Inoue et al. | |
| 2006/0145969 | A1 | 7/2006 | Fish et al. | |
| 2008/0100542 | A1 | 5/2008 | Miller et al. | |
| 2009/0219308 | A1* | 9/2009 | Sagano | G09G 3/2081 345/690 |
| 2010/0020065 | A1 | 1/2010 | Takasugi | |
| 2010/0171774 | A1* | 7/2010 | Mizukoshi | G09G 3/3275 345/690 |
| 2011/0242087 | A1* | 10/2011 | Ebisuno | G09G 3/3233 345/212 |
| 2012/0327066 | A1* | 12/2012 | Kato | G09G 3/3225 345/212 |
| 2012/0327067 | A1 | 12/2012 | Kato | |

FOREIGN PATENT DOCUMENTS

| | | |
|---|---|---|
| JP | 2003-280590 | 10/2003 |
| JP | 2006-065148 | 3/2006 |
| JP | 2006-349986 | 12/2006 |
| JP | 2007-520730 | 7/2007 |
| JP | 2008-185809 | 8/2008 |
| JP | 2008-281798 | 11/2008 |
| JP | 2010-508559 | 3/2010 |
| WO | 03/027999 | 4/2003 |
| WO | 2004/114273 | 12/2004 |
| WO | 2008/057187 | 5/2008 |
| WO | 2011/086597 | 7/2011 |
| WO | 2012/001991 | 1/2012 |
| WO | 2012/077258 | 6/2012 |

* cited by examiner

| Light emission luminance (Video data) | Reference level of luminance signal |
|---|---|
| 0 | 0.000 |
| 128 | 0.128 |
| 256 | 0.256 |
| 384 | 0.384 |
| 512 | 0.512 |
| 640 | 0.640 |
| 768 | 0.768 |
| 896 | 0.896 |
| 1024 | 1.024 |

| Reference level | Corrected level @Vdrop = 3V | Corrected level @Vdrop = 5V |
|---|---|---|
| 0.000 | 0.000 | 0.000 |
| 0.128 | 0.128 | 0.128 |
| 0.256 | 0.256 | 0.256 |
| 0.384 | 0.384 | 0.384 |
| 0.512 | 0.512 | 0.512 |
| 0.640 | 0.640 | 0.640 |
| 0.768 | 0.800 | 0.835 |
| 0.896 | 1.000 | 1.117 |
| 1.024 | 1.300 | 1.589 |

DISPLAY DEVICE AND METHOD FOR DRIVING SAME

TECHNICAL FIELD

The present invention relates to an active-matrix display device including current-driven light-emitting elements represented by organic electro-luminescent (EL) elements, and a method for driving the display device.

BACKGROUND ART

In general, the luminance of an organic EL element depends on a drive current supplied to the element. The light emission luminance of the element increases in proportion to the drive current. Accordingly, the power consumption of a display including organic EL elements is determined by an average display luminance. In other words, unlike a liquid crystal display, the power consumption of the organic EL display significantly varies depending on the display image. For example, the organic EL display consumes the greatest amount of power when displaying an absolute white image, whereas the organic EL display consumes power of approximately 20% to 40% of the power required for the absolute white image when displaying a general natural image.

However, a power circuit capacity and a battery capacity are designed in view of a case where the display consumes the greatest amount of power. Hence, the amount of power consumption that is three to four times as high as that required for a general natural image has to be taken into consideration. This hinders reduction of power consumption of devices and downsizing of the devices.

In view of this, there is a conventional technique which reduces power consumption with little decrease in display luminance (for example, see PTL 1). In the technique, the reduction is achieved by detecting a peak value of video data, adjusting the cathode voltage of an organic EL element based on the detected data only when a driving transistor which drives the organic EL element operates in a saturated region, and decreasing a drive voltage supplied to a display.

CITATION LIST

Patent Literature

[PTL 1] Japanese Unexamined Patent Application Publication No. 2006-65148

SUMMARY OF INVENTION

Technical Problem

However, the power consumption of the display device according to the technique disclosed in PTL 1 allows for further reduction.

The present invention has been conceived in view of the above. An object of the present invention is to provide a display device with significantly reduced power consumption and a method for driving the display device.

Solution to Problem

In order to solve the above problem, a display device according to one aspect of the present invention includes: a display unit including a plurality of light-emitting pixels in an array, each of the light-emitting pixels including: a light-emitting element which emits light according to a supplied current; and a driving transistor which supplies, to the light-emitting element, a drive current corresponding to a level of a luminance signal; a voltage source which generates a drive voltage to be supplied to the display unit; a power supply line connected to the plurality of light-emitting pixels and the voltage source to supply the drive voltage from the voltage source to each of the plurality of light-emitting pixels; a voltage drop amount estimating unit which estimates an amount of voltage drop on the power supply line between the voltage source and each of the plurality of light-emitting pixels, using video data indicating a light emission luminance of each of the plurality of light-emitting pixels; a first storage unit which holds correction information indicating a relationship between a luminance at which the light-emitting element emits light and a level of the luminance signal, the relationship being obtained when the driving transistor operates both in a linear region and a saturated region; a second storage unit which holds reference characteristic information indicating a relationship between a luminance at which the light-emitting element emits light and a level of the luminance signal, the relationship being obtained when the driving transistor operates in the saturated region; and a luminance signal correcting unit which generates the luminance signal having a corrected level by correcting a reference level based on the estimated amount of voltage drop and the correction information, the reference level being a level of the luminance signal associated, by the reference characteristic information, with the light emission luminance indicated by the video data.

Advantageous Effects of Invention

According to a display device disclosed herein, even when the driving transistor operates in a linear region, it is possible to obtain simulated operating characteristics in a saturated region due to a luminance signal having a corrected level. As a result, it is possible to reduce a drive voltage to be supplied to each light-emitting pixel to a level at which the driving transistor operates in the linear region, and to cause a light-emitting element to accurately emit light at a desired luminance. This leads to a display device with significantly reduced power consumption.

Figure 1:
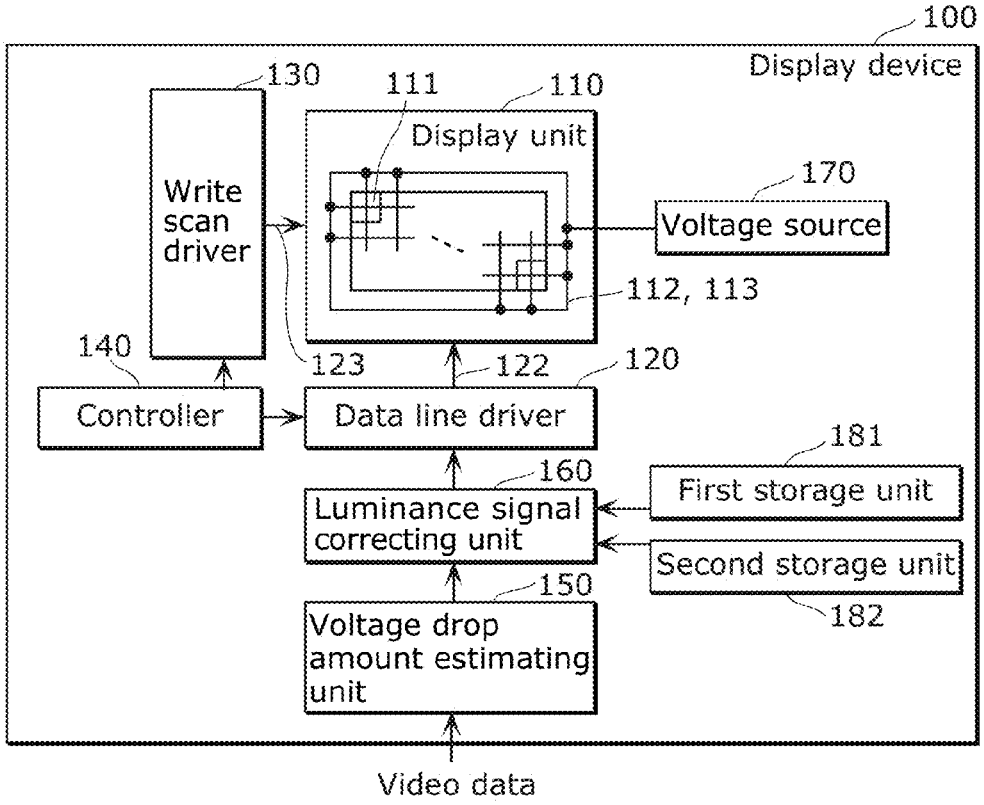
FIG. 1 is a functional block diagram illustrating an example of a configuration of a display device according to an embodiment.

DESCRIPTION OF EMBODIMENT (Details of Underlying Knowledge Forming Basis of the Present Invention)

PTL 2 (International Publication No. WO2012/001991) points out the following problem of the display device described in the background art section.

In the display device disclosed in PTL 1, in order to cause a driving transistor which drives an organic EL element to operate in a saturated region, a drive voltage to be supplied to a display needs to include a margin for compensating the amount of possible voltage drop on a power supply line for transmitting the drive voltage. In the case where such a margin is secured at a fixed level, that is, in the case where a margin corresponding to the amount of maximum possible voltage drop on the power supply line is always included in the drive voltage, unnecessary power is consumed for a general image.

In order to deal with such a problem, the display device disclosed in PTL 2 estimates, for each light-emitting pixel, a distribution of the amount of voltage drop on a power supply line from video data indicating the light emission luminance of each light-emitting pixel, and adjusts a drive voltage to be supplied to the power supply line based on the estimated distribution of the amount of voltage drop for each light-emitting pixel. This allows a margin included in the drive voltage to be adapted to actually displayed video data and reduced. Accordingly, power consumption of the display device can be further reduced.

In both the techniques disclosed in PTL 1 and PTL 2, a driving transistor which supplies a drive current of an organic EL element is caused to operate in the saturated region, that is, at a constant current. With this, the effects of a source-drain voltage of the driving transistor on the drive current are reduced, which allows the drive current to be accurately controlled while depending on only a gate-source voltage of the driving transistor. In other words, it is possible to cause an organic EL to emit light at a desired luminance.

Since the operation of the driving transistor in the linear region leads to a further reduction in drive voltage supplied to the power supply line, causing the driving transistor to operate in the linear region is considered to be effective for reducing the power consumption of the display device. However, in the techniques of PTL 1 and PTL 2, causing the driving transistor to operate in the linear region exposes the effects of the source-drain voltage of the driving transistor on the drive current of the organic EL element. Hence, it may hinder accurate light emission of the light-emitting element at a desired luminance.

In order to solve such a problem, a display device according to one aspect of the present invention includes: a display unit including a plurality of light-emitting pixels in an array, each of the plurality of light-emitting pixels including: a light-emitting element which emits light according to a supplied current; and a driving transistor which supplies, to the light-emitting element, a drive current corresponding to a level of a luminance signal; a voltage source which generates a drive voltage to be supplied to the display unit; a power supply line connected to the plurality of light-emitting pixels and the voltage source to supply the drive voltage from the voltage source to each of the plurality of light-emitting pixels; a voltage drop amount estimating unit which estimates an amount of voltage drop on the power supply line between the voltage source and each of the plurality of light-emitting pixels, using video data indicating a light emission luminance of each of the plurality of light-emitting pixels; a first storage unit which holds correction information indicating a relationship between a luminance at which the light-emitting element emits light and a level of the luminance signal, the relationship being obtained when the driving transistor operates both in a linear region and a saturated region; a second storage unit which holds reference characteristic information indicating a relationship between a luminance at which the light-emitting element emits light and a level of the luminance signal, the relationship being obtained when the driving transistor operates in the saturated region; and a luminance signal correcting unit which generates the luminance signal having a corrected level by correcting a reference level based on the estimated amount of voltage drop and the correction information, the reference level being a level of the luminance signal associated, by the reference characteristic information, with the light emission luminance indicated by the video data.

With this, even when the driving transistor operates in the linear region, it is possible to obtain simulated operating characteristics in the saturated region due to a luminance signal having a corrected level. As a result, it is possible to reduce a drive voltage to be supplied to each light-emitting pixel to a level at which the driving transistor operates in the linear region, and to cause each light-emitting element to accurately emit light at a desired luminance. This leads to a display device with significantly reduced power consumption.

Moreover, for example, it may be that the amount of voltage drop includes a plurality of amounts of voltage drops different from each other, the first storage unit holds the correction information for each of the plurality of amounts of voltage drops, and the luminance signal correcting unit is configured to generate the luminance signal having the corrected level by correcting the reference level using the correction information corresponding to one of the plurality of amounts of voltage drops estimated by the voltage drop amount estimating unit.

With this, the characteristics which differ depending on the amount of voltage drop can be accurately corrected.

Moreover, for example, it may be that the first storage unit holds, as the correction information, information indicating an association between (i) a level of the luminance signal for causing the light-emitting element to emit light at a predetermined luminance when the driving transistor operates both in the linear region and the saturated region and (ii) a level of the luminance signal for causing the light-emitting element to emit light at the predetermined luminance when the driving transistor operates in the saturated region, and the luminance signal correcting unit is configured to generate the luminance signal having a level associated with the reference level by the correction information.

With this, regardless of whether the driving transistor operates in the linear region or in the saturated region, it is possible to cause the light emitting element to emit light at the same luminance.

Moreover, for example, a driving method according to one aspect disclosed herein is a method for driving a display device. The display device includes: a display unit including a plurality of light-emitting pixels in an array, each of the plurality of light-emitting pixels including a light-emitting element which emits light according to a supplied current and a driving transistor which supplies, to the light-emitting element, a drive current corresponding to a level of a luminance signal; a voltage source which generates a drive voltage to be supplied to the display unit; a power supply line connected to the plurality of light-emitting pixels and the voltage source to supply the drive voltage from the voltage source to each of the plurality of light-emitting pixels; a voltage drop amount estimating unit; a first storage unit which holds correction information indicating a relationship between a luminance at which the light-emitting element emits light and a level of the luminance signal, the relationship being obtained when the driving transistor operates both in a linear region and a saturated region; and a second storage unit which holds reference characteristic information indicating a relationship between a luminance at which the light-emitting element emits light and a level of the luminance signal, the relationship being obtained when the driving transistor operates in the saturated region; and a luminance signal correcting unit. The method includes: estimating, by the voltage drop amount estimating unit, an amount of voltage drop on the power supply line between the voltage source and each of the plurality of light-emitting pixels, using video data indicating a light emission luminance of each of the plurality of light-emitting pixels; and generating, by the luminance signal correcting unit, the luminance signal having a corrected level by correcting a level of the luminance signal based on the estimated amount of voltage drop and the correction information, the level of the luminance signal being associated, by the reference characteristic information, with the light emission luminance indicated by the video data.

With this, even when the driving transistor operates in the linear region, it is possible to obtain simulated operating characteristics in the saturated region due to a luminance signal having a corrected level. As a result, a drive voltage to be supplied to each light-emitting pixel can be reduced to the level at which the driving transistor operates in the linear region. Accordingly, it is possible to provide a method for driving a display device with significantly reduced power consumption.

It is to be noted that these generic and specific aspects may be implemented using a system, a method, or an integrated circuit, and may also be implemented by any combination of systems, methods, and integrated circuits.

Hereinafter, a display device and a method for driving the display device according to one aspect disclosed herein will be described in detail with reference to the drawings.

It should be noted that the embodiment described below shows a specific example of the present invention. The numerical values, shapes, materials, structural elements, the arrangement and connection of the structural elements, steps, the processing order of the steps etc. shown in the following embodiment are mere examples, and therefore do not limit the present invention. Among the structural elements in the following embodiment, structural elements not recited in any one of the independent claims which indicate the broadest concepts are described as arbitrary structural elements.

Embodiment

FIG. 1 is a block diagram illustrating an example of a functional configuration of a display device according to an embodiment.

A display device 100 illustrated in FIG. 1 is a device which displays video according to video data which is data indicating light emission luminance of each of light-emitting pixels. The display device 100 includes: a display unit 110; power supply lines 112 and 113; a data line driver 120; a data line 122; a write scan driver 130; a scanning line 123; a controller 140; a voltage drop amount estimating unit 150; a luminance signal correcting unit 160; a voltage source 170; a first storage unit 181; and a second storage unit 182.

The display unit 110 includes a plurality of light-emitting pixels 111 in an array. Each of the light-emitting pixels 111 includes: a light-emitting element which emits light according to a supplied current; and a driving transistor which supplies, to the light-emitting element, a drive current corresponding to the level of a luminance signal externally provided. The light-emitting pixels 111 may be arranged in rows and columns.

The voltage source 170 generates a drive voltage to be supplied to the display unit 110.

The power supply lines 112 and 113 are connected to the light-emitting pixels 111 and the voltage source 170 to supply the drive voltage from the voltage source 170 to each light-emitting pixel 111 of the display unit 110.

The data line 122 is disposed for each column. The light-emitting pixels 111 belonging to the same column are connected to the data line driver 120 via the data line 122 disposed for the column.

The scanning line 123 is disposed for each row. The light-emitting pixels 111 belonging to the same row are connected to the write scan driver 130 via the scanning line 123 disposed for the row.

The voltage drop amount estimating unit 150 estimates, using the video data, the amount of voltage drop on at least one of the power supply lines 112 and 113 between the voltage source 170 and each light-emitting pixel 111.

The first storage unit 181 holds correction information indicating a relationship between a level of a luminance signal and a luminance of the light-emitting element. The relationship is a relationship obtained when the driving transistor in the light-emitting pixel 111 operates in a linear region.

The second storage unit 182 holds reference characteristic information indicating a relationship between a level of a luminance signal and a luminance of the light-emitting element. The relationship is a relationship obtained when the driving transistor in the light-emitting pixel 111 operates in a saturated region.

The luminance signal correcting unit 160 generates a luminance signal having a corrected level for each column by correcting a reference level based on the amount of voltage drop and the correction information. The reference level is the level of the luminance signal associated, by the reference characteristic information, with the light emission luminance indicated by the video data.

The data line driver 120 outputs the generated luminance signal to the data line 122 of the corresponding column.

The write scan driver 130 sequentially outputs scanning signals to the scanning line 123 for each row.

The controller 140 instructs a driving timing to each of the data line driver 120 and the write scan driver 130.

In the display device 100 configured as above, each light-emitting pixel 111 emits light at a luminance corresponding to the level of the luminance signal supplied from the data line driver 120, while using the drive voltage supplied from the power supply lines 112 and 113 as power. With this, video is displayed on the display unit 110 according to the video data.

Figure 2:
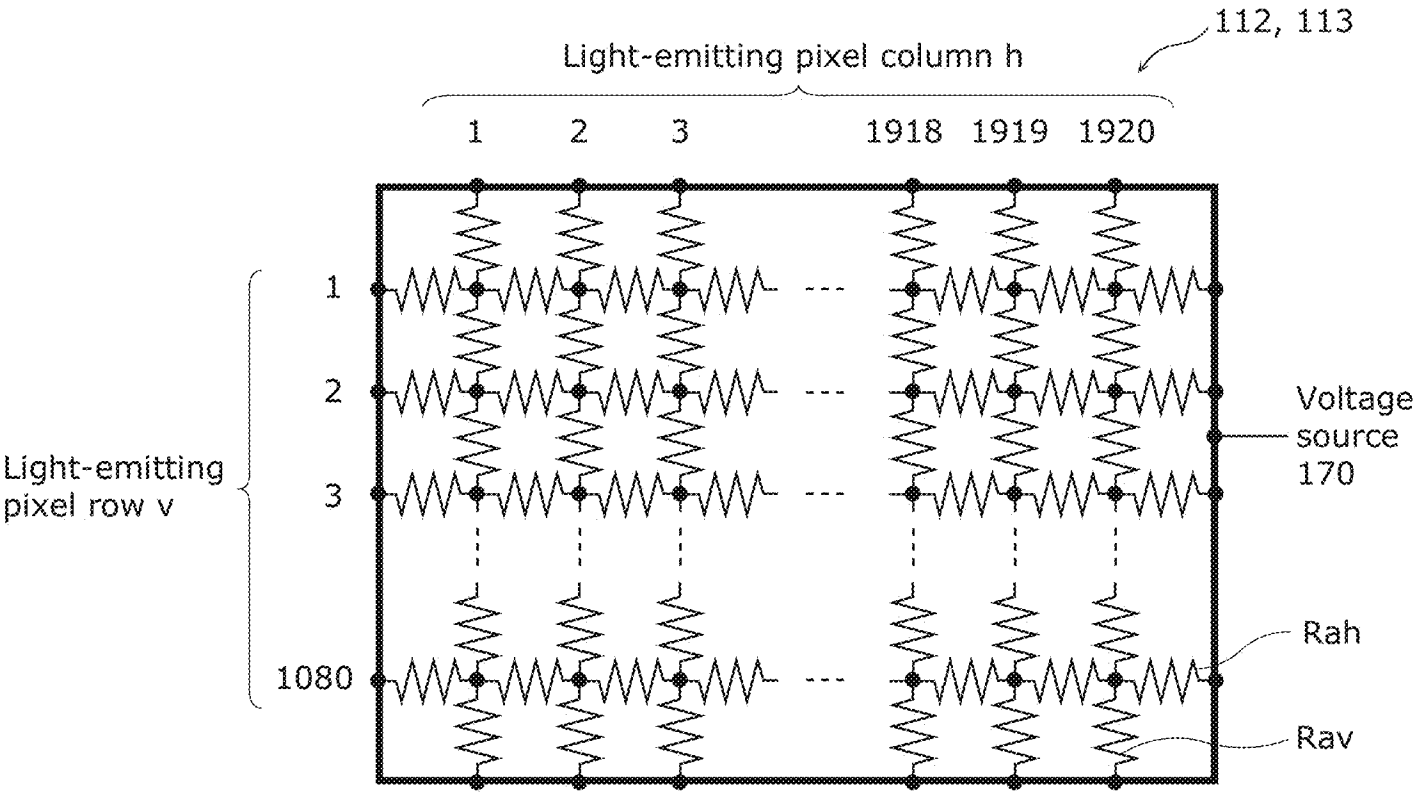
FIG. 2 illustrates an example of an equivalent circuit of power supply lines.

FIG. 2 illustrates an example of an equivalent circuit of the power supply line 112.

In FIG. 2, Rah represents a resistance component of the power supply line 112 between the connection points of the power supply line 112 with the light-emitting pixels 111 belonging to adjacent columns. Rav represents a resistance component of the power supply line 112 between the connection points of the power supply line 112 with the light-emitting pixels 111 belonging to adjacent rows. A drive voltage is applied from the voltage source 170 to the peripheral portion of the power supply line 112. Such a power supply line 112 is provided in the display unit 110 including the light-emitting pixels 111 arranged in a matrix of, for example, 1080 rows and 1920 columns, so that a drive voltage applied from the voltage source 170 can be supplied to each light-emitting pixel 111. In the following description, for the purpose of illustration, h represents a column number and v represents a row number.

A drive voltage is a power for causing each light-emitting pixel 111 to emit light. The drive voltage may include, for example, a positive voltage and a negative voltage which is lower than the positive voltage. For example, it may be that a positive voltage is supplied to each light-emitting pixel 111 from the voltage source 170 via the power supply line 112, and that a negative voltage is supplied to each light-emitting pixel 111 from the voltage source 170 via the power supply line 113 represented by an equivalent circuit similar to that of the power supply line 112. The negative voltage may be a ground voltage common in the display device 100. The power supply lines 112 and 113 each may be specifically a wiring network formed by patterning conductive materials, or may be a non-patterned film including transparent conductive materials.

Figure 3:
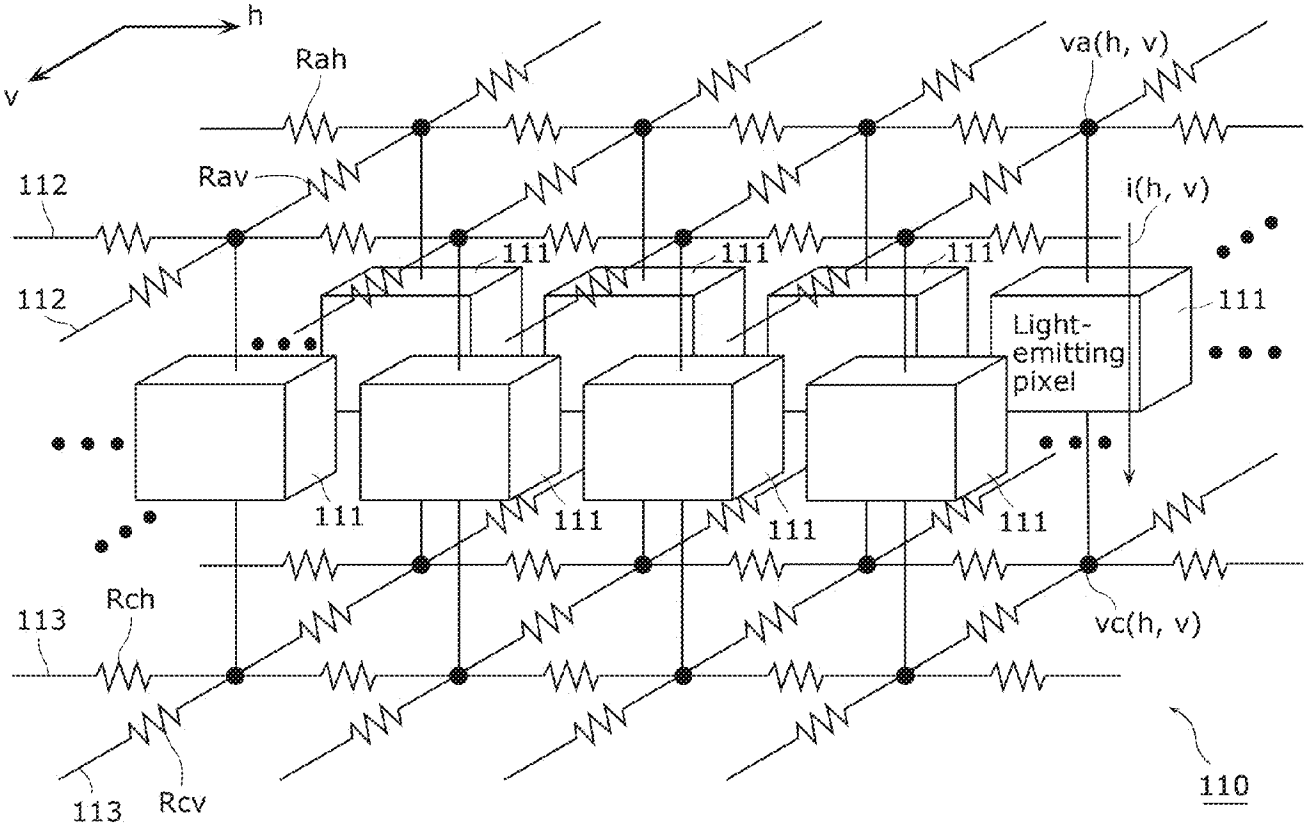
FIG. 3 is a perspective view schematically illustrating a configuration of a display unit.

FIG. 3 is a perspective view schematically illustrating a configuration of the display unit 110.

As FIG. 3 illustrates, the display unit 110 includes the light-emitting pixels 111 and the power supply lines 112 and 113. With respect to the light-emitting pixel 111 positioned at column h and row v, va(h, v) represents a voltage at the connection point of the light-emitting pixel 111 with the power supply line 112, vc(h, v) represents a voltage at the connection point of the light-emitting pixel 111 with the power supply line 113, and i(h, v) represents a current flowing through the light-emitting pixel 111. In a similar manner to the power supply line 112, the power supply line 113 is also represented by an equivalent circuit with the resistance components Rch and Rcv between the connection points of the power supply line 113 with adjacent light-emitting pixels 111.

Each light-emitting pixel 111 emits light at a luminance corresponding to the amount of current flowing through the light-emitting pixel 111, using the drive voltage supplied from the power supply lines 112 and 113 as power.

Figure 4:
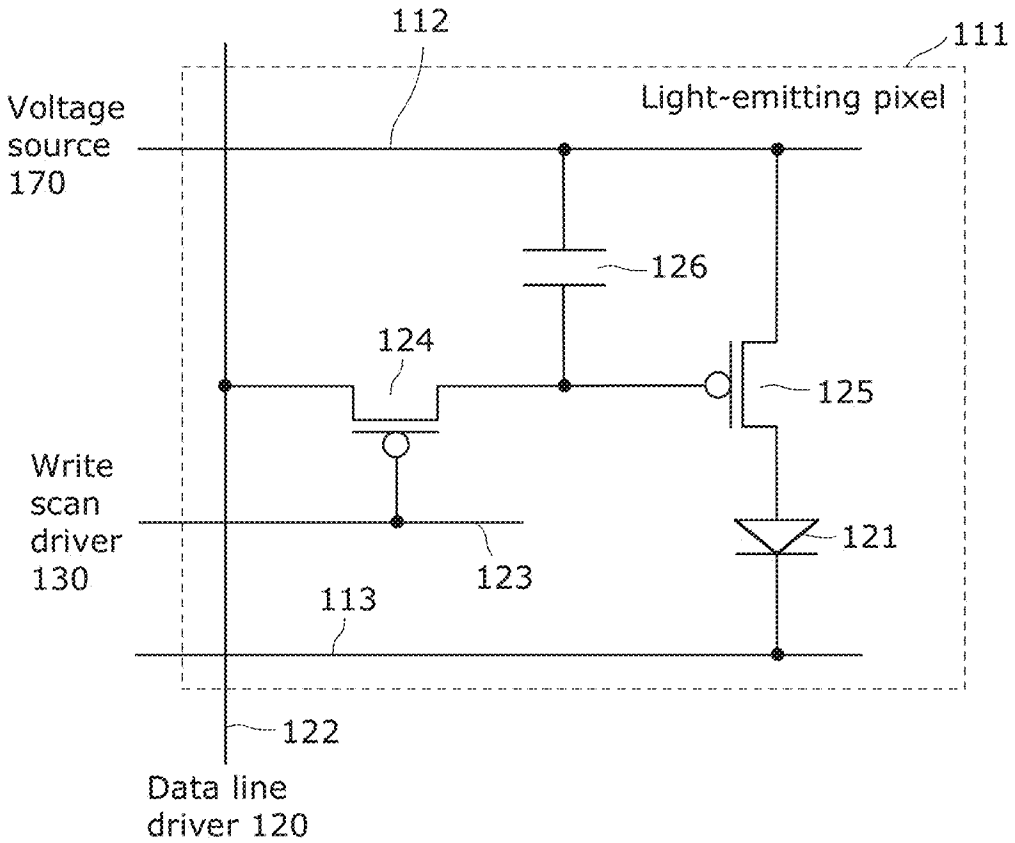
FIG. 4 is a circuit diagram illustrating an example of a configuration of a light-emitting pixel.

FIG. 4 is a circuit diagram illustrating an example of a configuration of each light-emitting pixel 111.

As FIG. 4 illustrates, the light-emitting pixel 111 includes: a light-emitting element 121; a selecting transistor 124; a driving transistor 125; and a capacitor 126.

The light-emitting element 121 is an element which emits light according to a current supplied from the driving transistor 125, and may include, for example, an organic EL element.

The selecting transistor 124 turns into a conducting state in response to a scanning signal supplied from the write scan driver 130 via the scanning line 123 to cause the capacitor 126 to store a luminance signal supplied from the data line driver 120 via the data line 122. The selecting transistor 124 may include, for example, a thin-film transistor.

The driving transistor 125 is an element which supplies, to the light-emitting element 121, a drive current corresponding to the level of the luminance signal stored in the capacitor 126.

It is to be noted that the configuration of the light-emitting pixel 111 illustrated in FIG. 4 is an example, and need not be the same. The configuration may be arbitrarily varied as long as: the light-emitting pixel 111 includes a circuit including the light-emitting element 121 and the driving transistor 125 connected in series; and a drive voltage is supplied across the terminals of the circuit from the power supply lines 112 and 113 and the light-emitting element 121 emits light using the drive voltage as power. For example, the selecting transistor 124 and the driving transistor 125 may be any one of a p-type transistor and an n-type transistor depending on the polarities of the scanning signal and the luminance signal. Moreover, for example, it may be that the light-emitting element 121 is connected in a direction opposite to that illustrated in FIG. 4 depending on the drive voltage supplied from the power supply lines 112 and 113.

Figure 5:
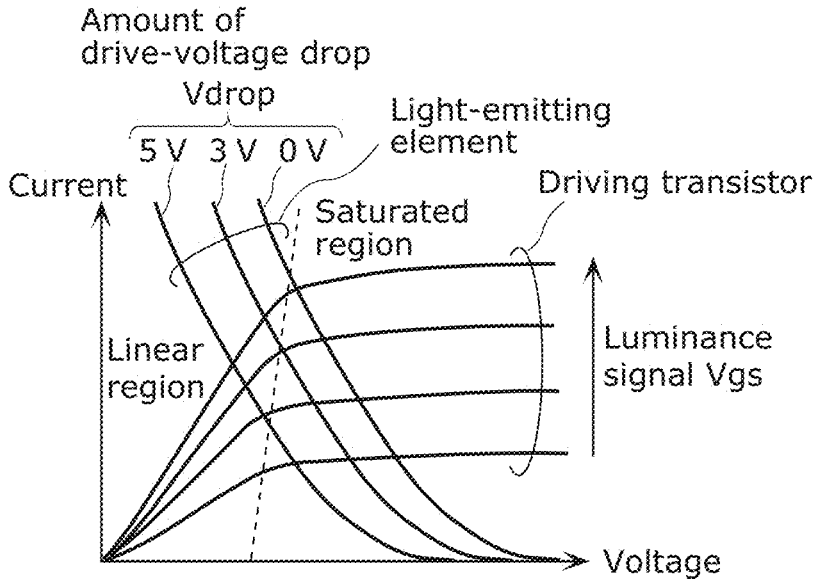
FIG. 5 illustrates operating points of the light-emitting pixel.

FIG. 5 illustrates operating points of the light-emitting pixel 111, and indicates the current-voltage characteristics of the light-emitting element 121 and the driving transistor 125. In the following description, for the purpose of illustration, it is assumed that a luminance signal is equal to a gate-source voltage of the driving transistor 125.

FIG. 5 illustrates, as the current-voltage characteristics of the driving transistor 125, a relationship between a drain current and a source-drain voltage for each of different gate-source voltages. The driving transistor 125 can operate both in a linear region in which a drain current depends on a source-drain voltage and a source-gate voltage, and in a saturated region in which a drain current substantially depends only on a source-gate voltage.

FIG. 5 also illustrates, as the current-voltage characteristics of the light-emitting element 121, a relationship between an anode-cathode current and a voltage obtained by subtracting the anode-cathode voltage of the light-emitting element 121 from the drive voltage, for each of different drive voltages applied to the light-emitting pixel 111. Here, each of the drive voltages corresponds to a different amount of voltage drop on the power supply lines 112 and 113 between the voltage source 170 and the light-emitting pixel 111.

The light-emitting pixel 111 operates at an operating point which is an intersection point of a characteristic curve of the light-emitting element 121 corresponding to the drive voltage applied to the light-emitting pixel 111 with a characteristic curve of the driving transistor 125 corresponding to the luminance signal applied to the light-emitting pixel 111. With a decrease in the drive voltage, that is, with an increase in the amount of voltage drop on the power supply lines 112 and 113, the operating point of the light-emitting pixel 111 is likely to be in the linear region of the driving transistor 125.

Figure 6:
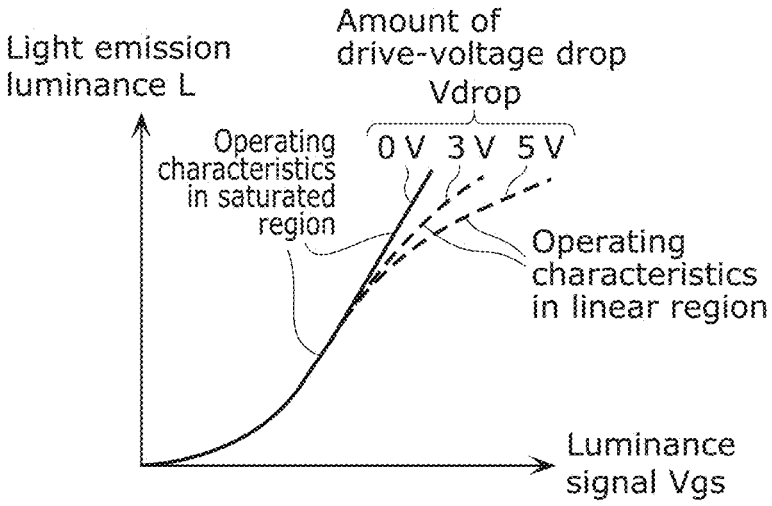
FIG. 6 illustrates light emission characteristics of the light-emitting pixel.

FIG. 6 illustrates light emission characteristics of the light-emitting pixel 111, and indicates a relationship between light emission luminance of the light-emitting pixel 111 and a luminance signal.

FIG. 6 shows that when same luminance signals are applied to the light-emitting pixel 111, the light emission luminance differs depending on whether the operating point of the light-emitting pixel 111 is in a linear region or in a saturated region.

In the conventional configuration, in order to avoid such unevenness in light emission luminance, the voltage source 170 generates a drive voltage which includes the amount of possible voltage drop on the power supply lines 112 and 113 and is supplied to the power supply lines 112 and 113. This prevents the operating point of the light-emitting pixel 111 from entering the linear region of the driving transistor 125.

As described earlier, since an operation of the driving transistor 125 in the linear region leads to a further reduction in drive voltage to be supplied to the power supply lines 112 and 113, causing the driving transistor 125 to operate in the linear region is effective for reducing the power consumption of the display device 100.

In view of the above, the display device 100 corrects the level of a luminance signal so as to cause the light-emitting pixel 111 to emit light at the same light emission luminance according to the video data indicating the same light emission luminance, regardless of whether the operating point of the light-emitting pixel 111 is in the linear region or in the saturated region of the driving transistor 125.

Figure 7:
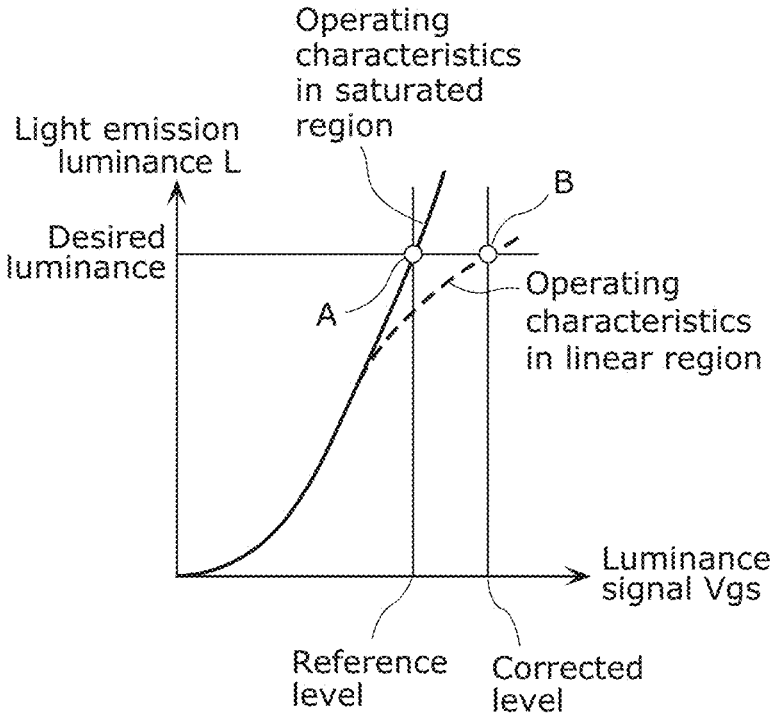
FIG. 7 illustrates correcting processing of a luminance signal.

FIG. 7 illustrates correcting processing of a luminance signal.

In FIG. 7, the level of a luminance signal for causing the light-emitting pixel 111 to emit light at a desired luminance is a reference level (point A) when the driving transistor 125 operates in a saturated region, and is a corrected level (point B) when the driving transistor 125 operates in a linear region. Here, the term "desired luminance" refers to, for example, luminance indicated by video data.

In other words, correction of the level of a luminance signal allows the light-emitting pixel 111 to emit light at the same light emission luminance, in any of the cases where the driving transistor 125 operates in the linear region and where the driving transistor 125 operates in the saturated region.

Such a correction may be performed specifically by correcting the level of a luminance signal at which the driving transistor 125 operates in the saturated region, based on the amount of voltage drop of the drive voltage and the light emission characteristics of the light-emitting pixel obtained when the driving transistor 125 operates in the linear region.

Next, an operation of the display device 100 configured as above will be described.

Figure 8:
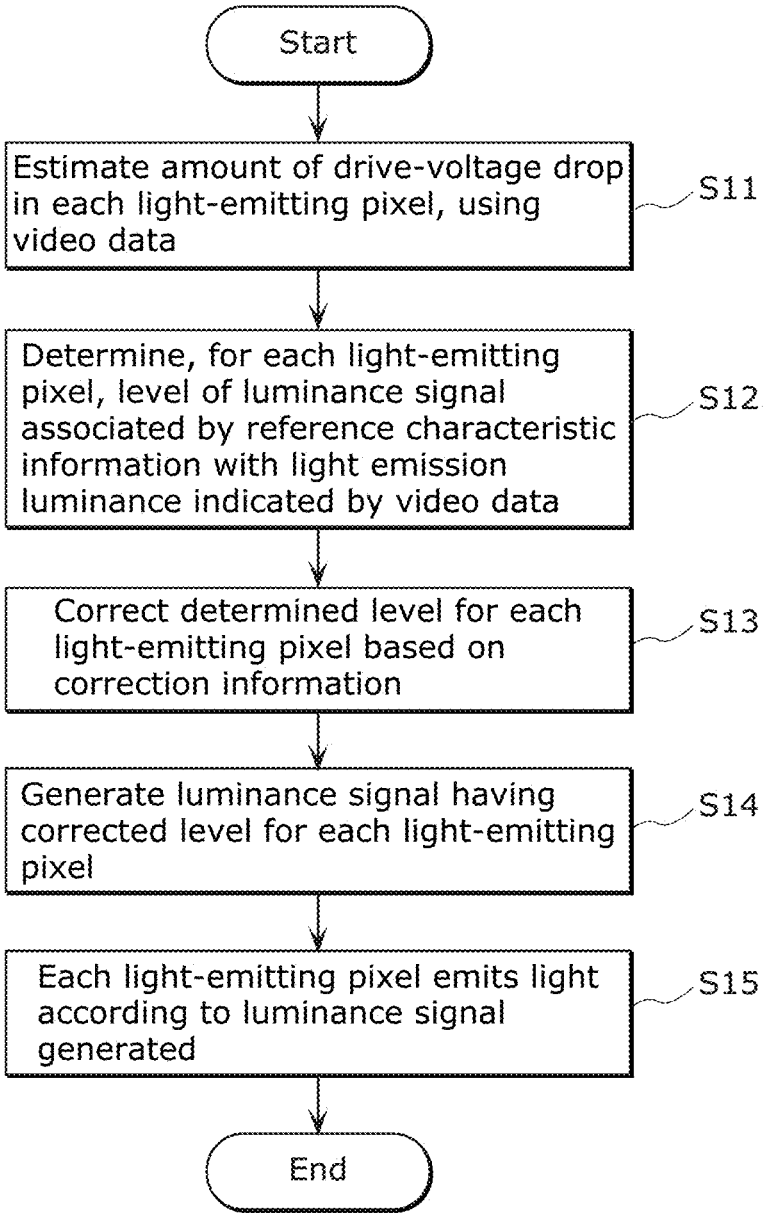
FIG. 8 is a flowchart of an example of an operation of the display device.

FIG. 8 is a flowchart of an example of an operation of the display device 100.

The flowchart in FIG. 8 may be, for example, executed for each picture included in video represented by video data.

In Step S11, the voltage drop amount estimating unit 150 estimates, using video data, the amount of drive-voltage drop in each light-emitting pixel 111. Here, the amount of drive-voltage drop in each light-emitting pixel 111 refers to, for example, the amount of voltage drop on the power supply line 112 between the voltage source 170 and the light-emitting pixel 111. There is a conventional method for estimating such an amount of voltage drop (for example, PTL 2).

The following describes the method disclosed in PTL 2 in which the amount of voltage drop on the power supply line 112 is estimated by calculating the distribution of voltages at the connection points of the power supply line 112 with the light-emitting pixels 111.

The voltage drop amount estimating unit 150 determines, using a conversion formula or a conversion table indicating a relationship between a pixel luminance value and a pixel current, the amount of current to be supplied to each light-emitting pixel 111 from the luminance value of each pixel of one picture represented by the video data.

The voltage drop amount estimating unit 150 then calculates, from the determined amount of current of each light-emitting pixel 111, the distribution of voltages at the connection points of the power supply line 112 with the light-emitting pixels 111 as below.

With the notation in FIG. 2 and FIG. 3, pixel current i(h, v) of the light-emitting pixel 111 positioned at column h and row v is expressed by Equation 1 below.

$$Rah\times\{va(h-1,v)-va(h,v)\}+Rah\times\{va(h+1,v)-va(h,v)\}+Rah\times\{va(h,v-1)-va(h,v)\}+Rav\times\{va(h,v+1)-va(h,v)\}=I(h,v) \quad \text{(Equation 1)}$$

Here, when the light-emitting pixels 111 are arranged in a matrix of, for example, 1920 columns and 1080 rows, h is an integer number ranging from 1 to 1920, and v is an integer number ranging from 1 to 1080.

The va(0, v), va(1921, v), va(h, 0), and va(h, 1081) are voltages of the peripheral portion of the power supply line 112. By approximating the amount of voltage drop between the voltage source 170 and the peripheral portion of the power supply line 112 to 0, the voltages are represented by constant numbers equal to a drive voltage generated by the voltage source 170.

The Rah and Rav are resistance components between the connection points of the power supply line with adjacent light-emitting pixels 111, and constant numbers determined based on the design value or the actual measured value of the power supply line 112.

These constant numbers may be, for example, stored in the voltage drop amount estimating unit 150 in advance and referred to when estimating the amount of voltage drop.

The voltage va(h, v) at the connection point of the power supply line 112 with each light emitting pixel 111 is obtained by writing Equation 1 for each light-emitting pixel 111 and solving them as a system of equations for variable va(h, v). From the difference between the drive voltage output from the voltage source 170 and va(h, v), the amount of voltage drop on the power supply line 112 between the voltage source 170 and each light-emitting pixel 111 is obtained.

In a similar manner, the voltage drop amount estimating unit 150 can obtain the amount of voltage drop on the power supply line 113 between the voltage source 170 and each light-emitting pixel 111.

In this manner, the voltage drop amount estimating unit 150 estimates the amount of voltage drop on one of or both of the power supply lines 112 and 113 between the voltage source 170 and each light-emitting pixel 111.

In step S12, the luminance signal correcting unit 160 determines, for each light-emitting pixel 111, the level of a luminance signal associated, by the reference characteristic information stored in the second storage unit 182, with the luminance value indicated by video data.

The reference characteristic information refers to information indicating a relationship between light emission luminance of the light-emitting element 121 and a level of a luminance signal. The relationship is obtained when the driving transistor 125 in the light-emitting pixel 111 operates in the saturated region.

Figures 9, 10:
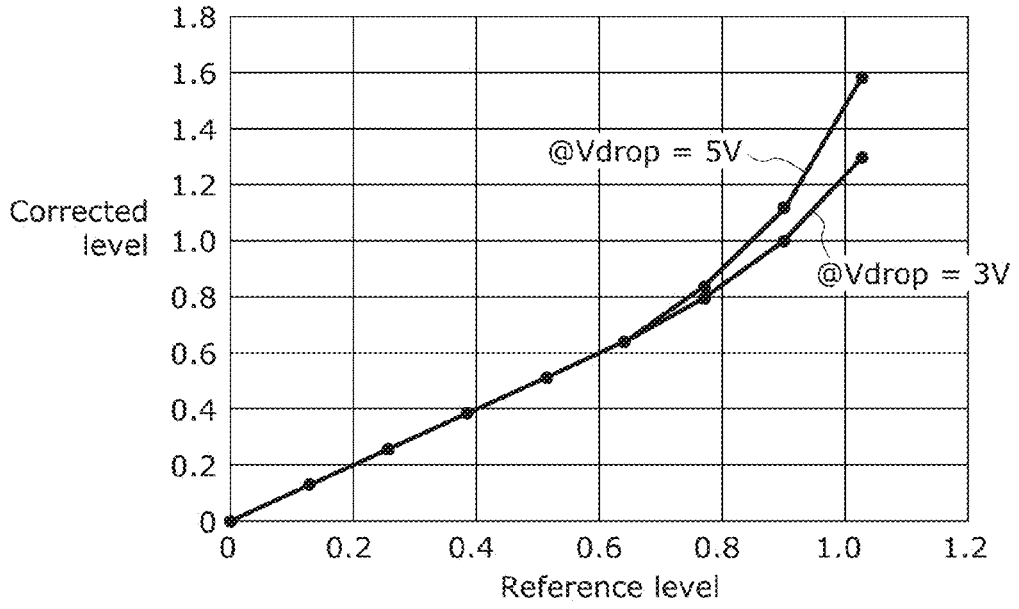
FIG. 9 illustrates an example of reference characteristic information.
FIG. 10 illustrates an example of correction information.

FIG. 9 illustrates an example of the reference characteristic information. The expression form of the reference characteristic information is not specifically limited. The reference characteristic information may be, as FIG. 9 illustrates as an example, a conversion table indicating a relationship between a pixel luminance value indicated by video data and a voltage value of a luminance signal. The level of the luminance signal may be an actual voltage value or a sign representing a voltage value. The reference characteristic information may be represented by a conversion formula.

With use of such reference characteristic information, the luminance signal correcting unit 160 determines, for each light-emitting pixel, the level of the luminance signal associated with the light emission luminance indicated by video data.

The reference characteristic information may be obtained, for example, by causing each light-emitting pixel 111 to emit light according to video data indicating predetermined luminance values while applying a drive voltage having a level at which the driving transistor 125 operates in the saturated region for all light emission luminance, and actually measuring the light emission luminance. The light emission luminance of each light-emitting pixel 111 may be, for example, measured by capturing an image of the display unit 110 using a camera.

In step S13, the luminance signal correcting unit 160 corrects, for each light-emitting pixel, the determined level of the luminance signal based on correction information.

The correction information refers to information indicating a relationship between light emission luminance of the light-emitting element 121 and a level of the luminance signal. The relationship is obtained when the driving transistor 125 in the light-emitting pixel 111 operates in the linear region.

FIG. 10 illustrates an example of the correction information. The expression form of the correction information is not specifically limited. The correction information may be, as FIG. 10 illustrates as an example, information indicating a relationship between a reference level and a corrected level of a luminance signal for causing the light-emitting element 121 to emit light at the same luminance regardless of whether the driving transistor 125 operates in the saturated region or both in the linear region and the saturated region. The relationship between the light emission luminance of the light-emitting element 121 and the reference level is associated by the reference characteristic information described above. Hence, such correction information indicates a relationship, between light emission luminance of the light-emitting element 121 and a corrected level of the luminance signal, obtained when the driving transistor 125 operates in the linear region.

Figures 11, 12:
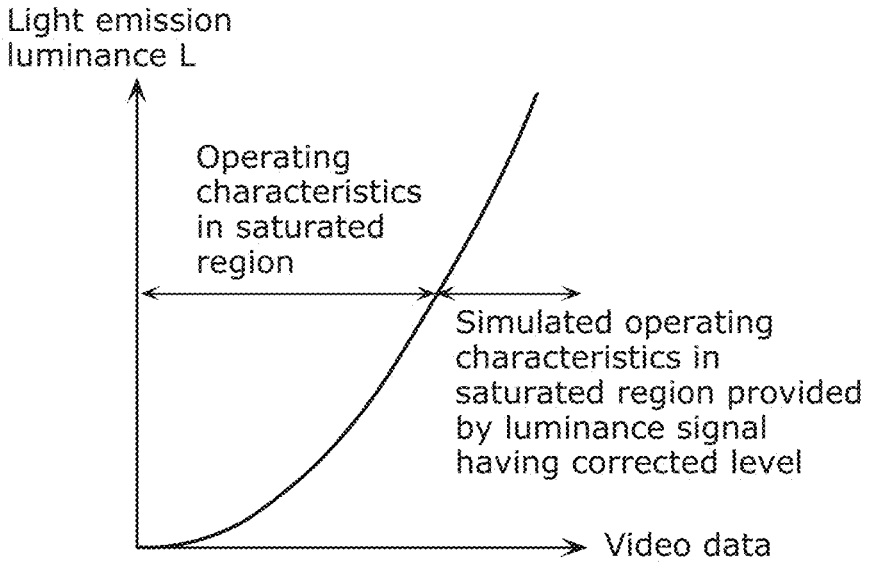
FIG. 11 illustrates an example of the correction information.
FIG. 12 illustrates effects of correcting processing of a luminance signal.

The correction information may more directly indicate a relationship between a luminance value of a pixel indicated by video data and a corrected level of a luminance signal. As FIG. 10 illustrates, the correction information may be provided for each amount of different voltage drops. The correction information may be indicated by a conversion table as illustrated in FIG. 11.

The luminance signal correcting unit 160 corrects the reference level of the luminance signal corresponding to the luminance value of the pixel indicated by video data, based on the amount of voltage drop estimated by the voltage drop amount estimating unit 150 and the correction information.

In Step S14, the luminance signal correcting unit 160 generates a luminance signal having a corrected level.

In step S15, each light-emitting pixel 111 emits light according to the luminance signal having a corrected level.

As a result, as FIG. 12 illustrates, even when the driving transistor 125 is actually operating in the linear region, it is possible to provide simulated light emission characteristics obtained when the driving transistor 125 operates in the saturated region due to the luminance signal having a corrected level.

Such a correction of the luminance signal may be performed according to the estimated amount of voltage drop, for example, only when the estimated amount of voltage drop is not substantially zero. When the estimated amount of voltage drop is substantially zero, a luminance signal having a reference level may be generated without such a correction. The correction may be performed using a correction information item selected from among a plurality of correction information items and corresponding to the estimated amount of voltage drop.

Figure 13:
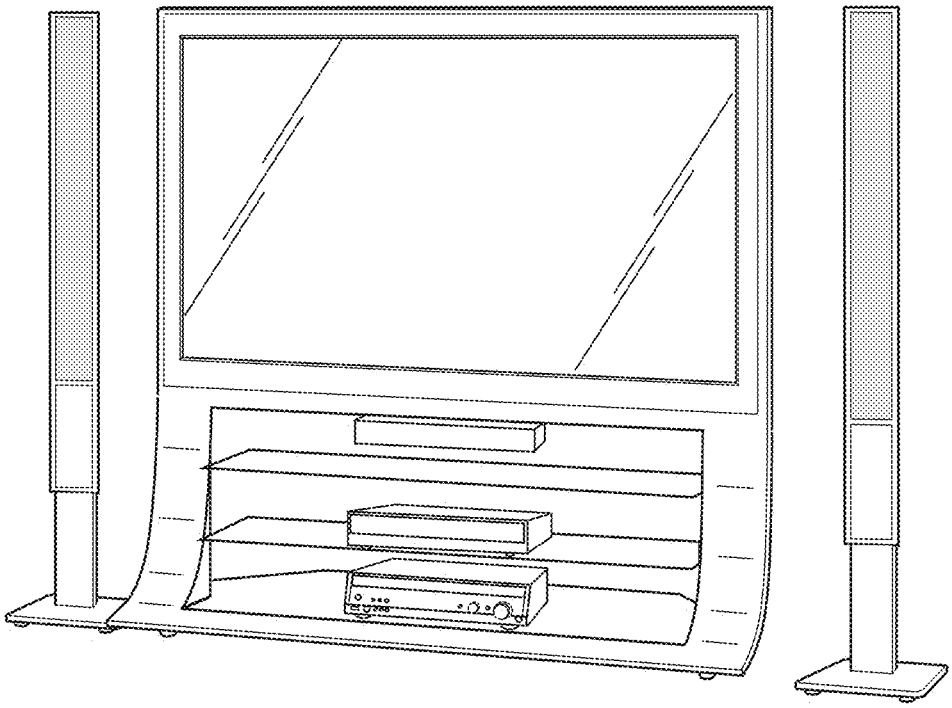
FIG. 13 is an external view of an example of a television receiving apparatus to which the display device according to the embodiment has been applied.

FIG. 13 is an external view of an example of a television receiving apparatus including the display device 100. With use of the display device 100, such a television receiving apparatus can obtain significant reduction of power consumption.

INDUSTRIAL APPLICABILITY

A display device disclosed herein can be widely used in a display device such as a television receiving apparatus.

REFERENCE SIGNS LIST

100 display device
110 display unit
111 light-emitting pixel
112, 113 power supply line
120 data line driver
121 light-emitting element
122 data line
123 scanning line
124 selecting transistor
125 driving transistor
126 capacitor
130 write scan driver
140 controller
150 voltage drop amount estimating unit
160 luminance signal correcting unit
170 voltage source
181 first storage unit
182 second storage unit

The invention claimed is:

1. A display device comprising:

a display including a plurality of light-emitting pixels in an array, each of the plurality of light-emitting pixels including:

a light-emitting element which emits light according to a supplied current;

a driving transistor which supplies, to the light-emitting element, a drive current corresponding to a level of a luminance signal;

a voltage source which generates a drive voltage to be supplied to the display;

a power supply line connected to the plurality of light-emitting pixels and the voltage source to supply the drive voltage from the voltage source to each of the plurality of light-emitting pixels;

a voltage drop amount estimating circuit configured to estimate an amount of voltage drop on the power supply line between the voltage source and each of the plurality of light-emitting pixels, using video data indicating a light emission luminance of each of the plurality of light-emitting pixels;

a first memory which holds correction information indicating a relationship between a luminance at which the light-emitting element emits light and a level of the luminance signal, the relationship being obtained when the driving transistor operates both in a linear region and a saturated region;

a second memory which holds reference characteristic information indicating a relationship between a luminance at which the light-emitting element emits light and a level of the luminance signal, the relationship being obtained when the driving transistor operates in the saturated region; and a luminance signal correcting circuit configured to generate the luminance signal having a corrected level by correcting a reference level based on the estimated amount of voltage drop and the correction information, the reference level being a level of the luminance signal associated, by the reference characteristic information, with the light emission luminance indicated by the video data.

2. The display device according to claim 1, wherein the amount of voltage drop includes a plurality of amounts of voltage drops different from each other, the first memory holds the correction information for each of the plurality of amounts of voltage drops, and the luminance signal correcting circuit is configured to generate the luminance signal having the corrected level by correcting the reference level using the correction information corresponding to one of the plurality of amounts of voltage drops estimated by the voltage drop amount estimating circuit.

3. The display device according to claim 1, wherein the first memory holds, as the correction information, information indicating an association between (i) a level of the luminance signal for causing the light-emitting element to emit light at a predetermined luminance when the driving transistor operates both in the linear region and the saturated region and (ii) a level of the luminance signal for causing the light-emitting element to emit light at the predetermined luminance when the driving transistor operates in the saturated region, and the luminance signal correcting circuit is configured to generate the luminance signal having a level associated with the reference level by the correction information.

4. A method for driving a display device, the method comprising:

emitting, by a light-emitting element included in each of a plurality of light-emitting pixels arranged in an array and disposed in a display, according to a supplied current and a driving transistor which supplies, to the light-emitting element, a drive current corresponding to a level of a luminance signal;

generating, by a voltage source, a drive voltage to be supplied to the display;

a power supply line connected to the plurality of light-emitting pixels and the voltage source to supply the drive voltage from the voltage source to each of the plurality of light-emitting pixels;

storing, in a first memory, correction information indicating a relationship between a luminance at which the light-emitting element emits light and a level of the luminance signal, the relationship being obtained when the driving transistor operates both in a linear region and a saturated region;

storing, in a second memory, reference characteristic information indicating a relationship between a luminance at which the light-emitting element emits light and a level of the luminance signal, the relationship being obtained when the driving transistor operates in the saturated region;

estimating, by a voltage drop amount estimating circuit, an amount of voltage drop on the power supply line between the voltage source and each of the plurality of light-emitting pixels, using video data indicating a light emission luminance of each of the plurality of light-emitting pixels; and generating, by a luminance signal correcting circuit, the luminance signal having a corrected level by correcting a level of the luminance signal based on the estimated amount of voltage drop and the correction information, the level of the luminance signal being associated, by the reference characteristic information, with the light emission luminance indicated by the video data.

* * * * *